US007729500B2

(12) United States Patent
Wu et al.

(10) Patent No.: US 7,729,500 B2
(45) Date of Patent: Jun. 1, 2010

(54) MICROPHONE ARRAY WITH ELECTROMAGNETIC INTERFERENCE SHIELDING MEANS

(75) Inventors: Li-Te Wu, Taipei (TW); Wei-Chan Hsu, Cupertino, CA (US)

(73) Assignee: Fortmedia, Inc., Cupertino, CA (US)

( * ) Notice: Subject to any disclaimer, the term of this patent is extended or adjusted under 35 U.S.C. 154(b) by 747 days.

(21) Appl. No.: 11/612,782

(22) Filed: Dec. 19, 2006

(65) Prior Publication Data

US 2008/0144874 A1 Jun. 19, 2008

(51) Int. Cl.

| | |
|---|---|
| ***H04R 25/00*** | (2006.01) |
| *H04R 9/08* | (2006.01) |
| *H04R 11/04* | (2006.01) |
| *H04R 17/02* | (2006.01) |
| *H04R 19/04* | (2006.01) |
| *H04R 21/02* | (2006.01) |

(52) U.S. Cl. ..... 381/189; 381/174; 381/369

(58) Field of Classification Search ..... 381/361, 381/189

See application file for complete search history.

(56) References Cited

U.S. PATENT DOCUMENTS

2005/0018864 A1* 1/2005 Minervini ..... 381/175

OTHER PUBLICATIONS

PCT International Search Report, Apr. 4, 2008.

* cited by examiner

*Primary Examiner*—Curtis Kuntz
*Assistant Examiner*—Matthew Eason
(74) *Attorney, Agent, or Firm*—Thomas, Kayden, Horstemeyer & Risley

(57) ABSTRACT

A microphone array comprises a circuit board, a first microphone, and a second microphone. The circuit board comprises a first layer, a third layer, and a second layer sandwiched between the first and third layers. The first layer comprises a first shielding part with a fixed electric potential. The third layer comprises a second shielding part with the fixed electric potential. The second layer comprises an electrically conductive part running between the first and second shielding parts. The first microphone is attached to the first layer of the circuit board. The second microphone is attached to the first layer of the circuit board and electrically connected to the first microphone through the electrically conductive part of the second layer of the circuit board.

7 Claims, 8 Drawing Sheets

MICROPHONE ARRAY WITH ELECTROMAGNETIC INTERFERENCE SHIELDING MEANS

BACKGROUND OF THE INVENTION

1. Field of the Invention

The invention relates to a microphone array with electromagnetic interference (EMI) shielding means.

2. Description of the Prior Art

FIG. 1 shows a conventional single microphone 100 used in various voice communication devices. The microphone 100 comprises an electret sensor 120 and an integrated circuit (e.g. J-channel field effect transistor, J-FET) 140 mounted in a housing 110. The electret sensor 120 comprises a diaphragm 121 and a back plate 122 both of which are permanently electrically charged to implement a capacitor. Incoming sound waves enter via a top opening 112 and are translated into mechanical vibrations upon contacting the diaphragm 121. The vibrations are converted into an electrical signal that varies in voltage amplitude and frequency corresponding to the original sound. The integrated circuit 140 receives and amplifies the electrical signal and provides an output signal. The integrated circuit 140 is mounted on a printed circuit board (PCB) 130 and is further coupled to external circuitry via openings 114 formed at the bottom of the housing 110. The housing 110 is made of metal serving as an electromagnetic interference (EMI) shielding means for protecting the integrated circuit 140 from EMI.

The described EMI shielding means, however, fails to provide full protection for a microphone array, which typically comprises at least two microphones mounted on a circuit board. External electromagnetic waves may penetrate through the circuit board affecting the integrated circuit therein.

BRIEF SUMMARY OF THE INVENTION

The invention provides a microphone array with EMI shielding means. The microphone array may include a circuit board, a first microphone, and a second microphone. The circuit board comprises a first layer, a third layer, and a second layer sandwiched between the first and third layers. The first layer comprises a first shielding part with a fixed electric potential. The third layer comprises a second shielding part with the fixed electric potential. The second layer comprises an electrically conductive part running between the first and second shielding parts. The first microphone is attached to the first layer of the circuit board. The second microphone is attached to the first layer of the circuit board and electrically connected to the first microphone through the electrically conductive part of the second layer of the circuit board.

The first microphone may comprise a first shielding housing electrically connected to the first shielding part, and the second microphone comprises a second shielding housing also electrically connected to the first shielding part.

The microphone array may further comprise an electrically conductive part which penetrates through the first, second, and third layers to electrically connect the first shielding part and the second shielding part.

The second shielding part may be grounded.

The microphone array may further comprise an electrically conductive part which electrically connects to the first microphone and penetrates through the first, second, and third layers to transmit signals between the first microphone and external circuitry.

The first microphone may comprise a first shielding housing and the first shielding housing defines an acoustic opening.

The first microphone may comprise a first shielding housing, the first shielding housing has an interior, and the circuit board defines an acoustic opening communicating with the interior of the first shielding housing.

The first microphone may be an omni-directional microphone or a uni-directional microphone.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
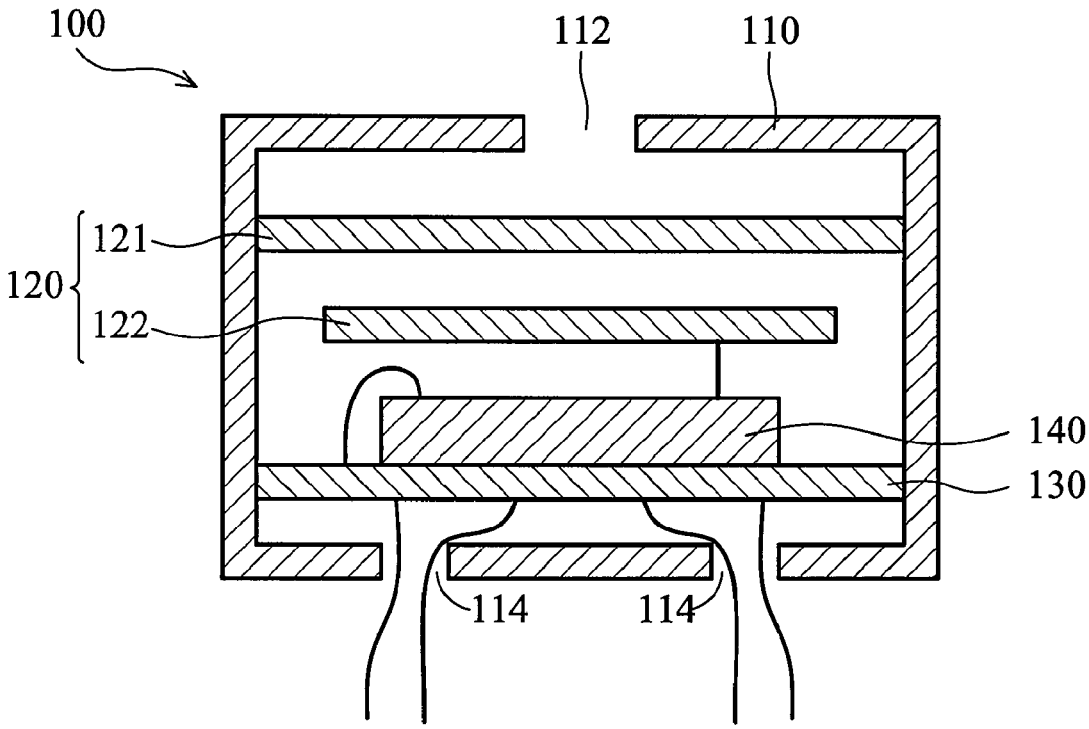
FIG. 1 ( PRIOR ART )
FIG. 1 shows a cross section of a conventional single microphone.
Figure 2A:
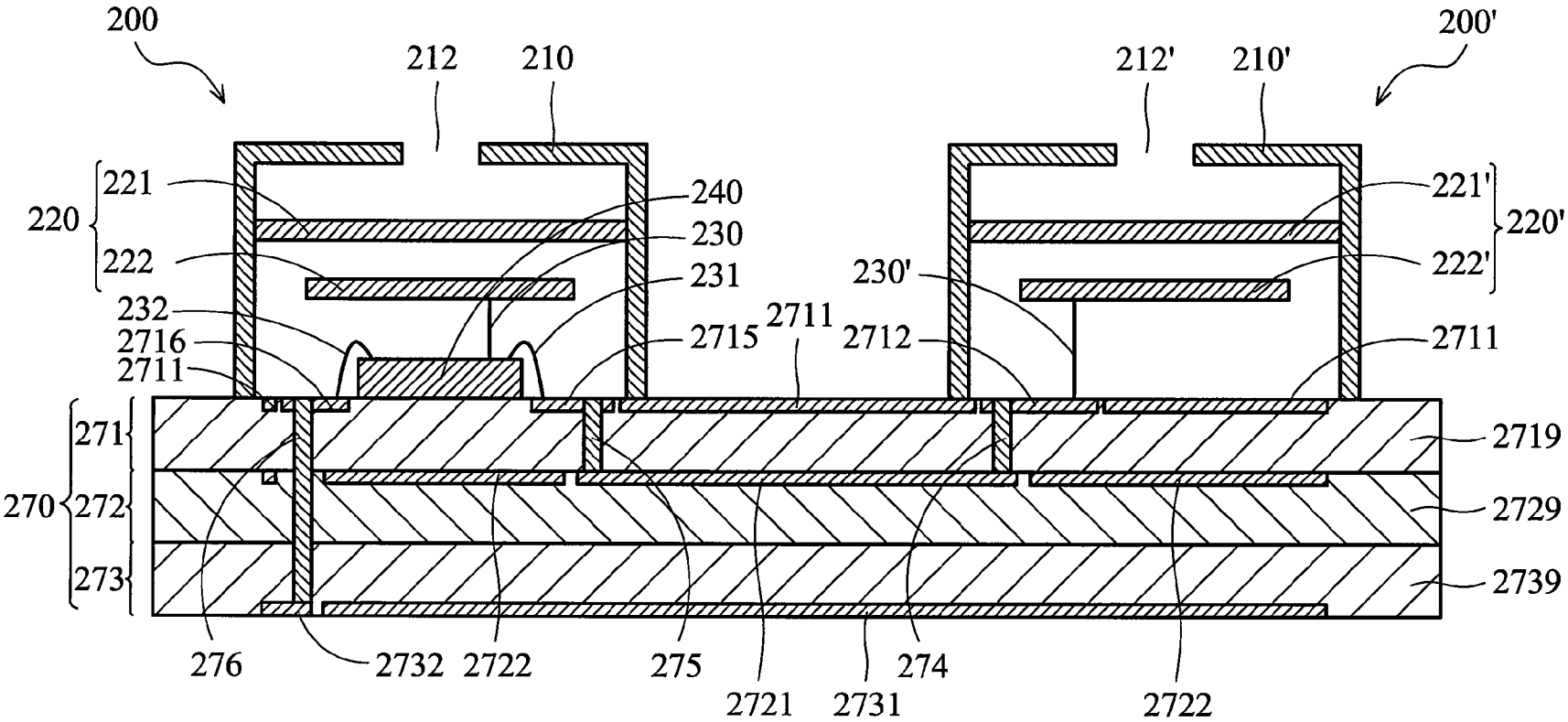
FIG. 2A shows a cross section of a microphone array in accordance with a first embodiment of the invention.

Referring to FIG. 2A, a microphone array of a first embodiment of the invention comprises a first microphone 200, a second microphone 200', and a circuit board 270. Both the first and second microphones 200 and 200', mounted on the circuit board 270, are omni-directional.

Figure 2B:
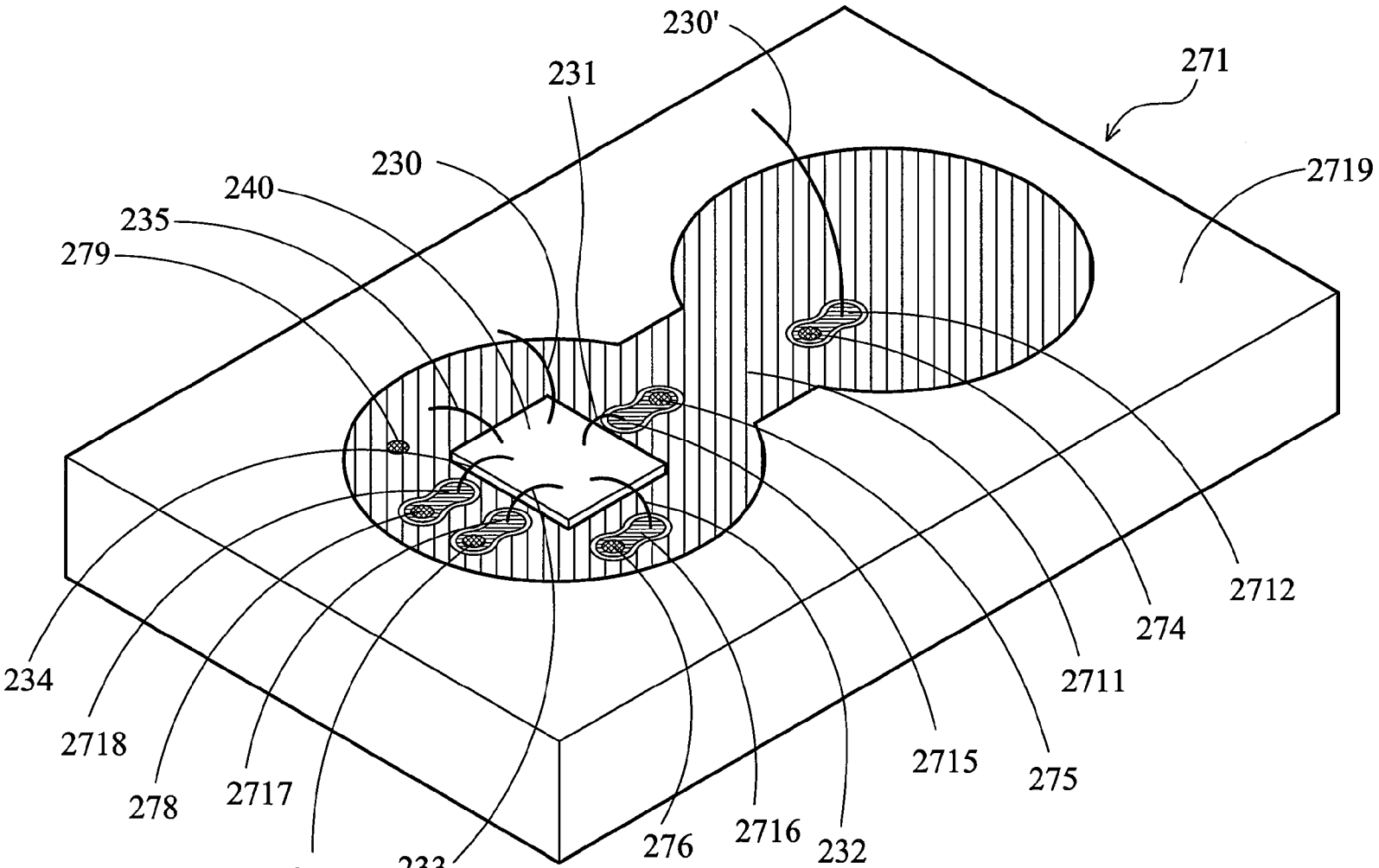
FIG. 2B depicts the first layer of the circuit board of FIG. 2A.
Figure 2C:
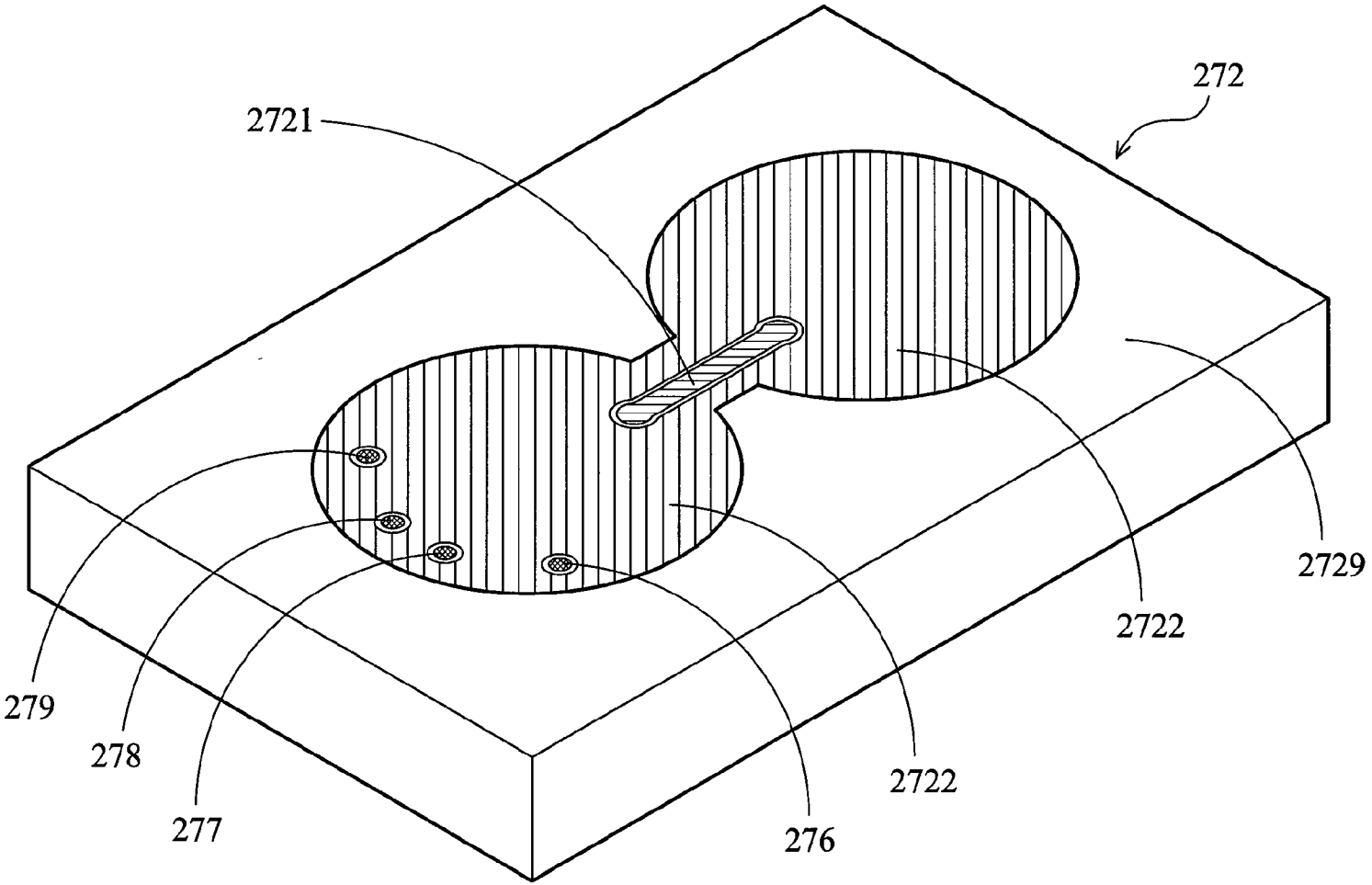
FIG. 2C depicts the second layer of the circuit board of FIG. 2A.
Figure 2D:
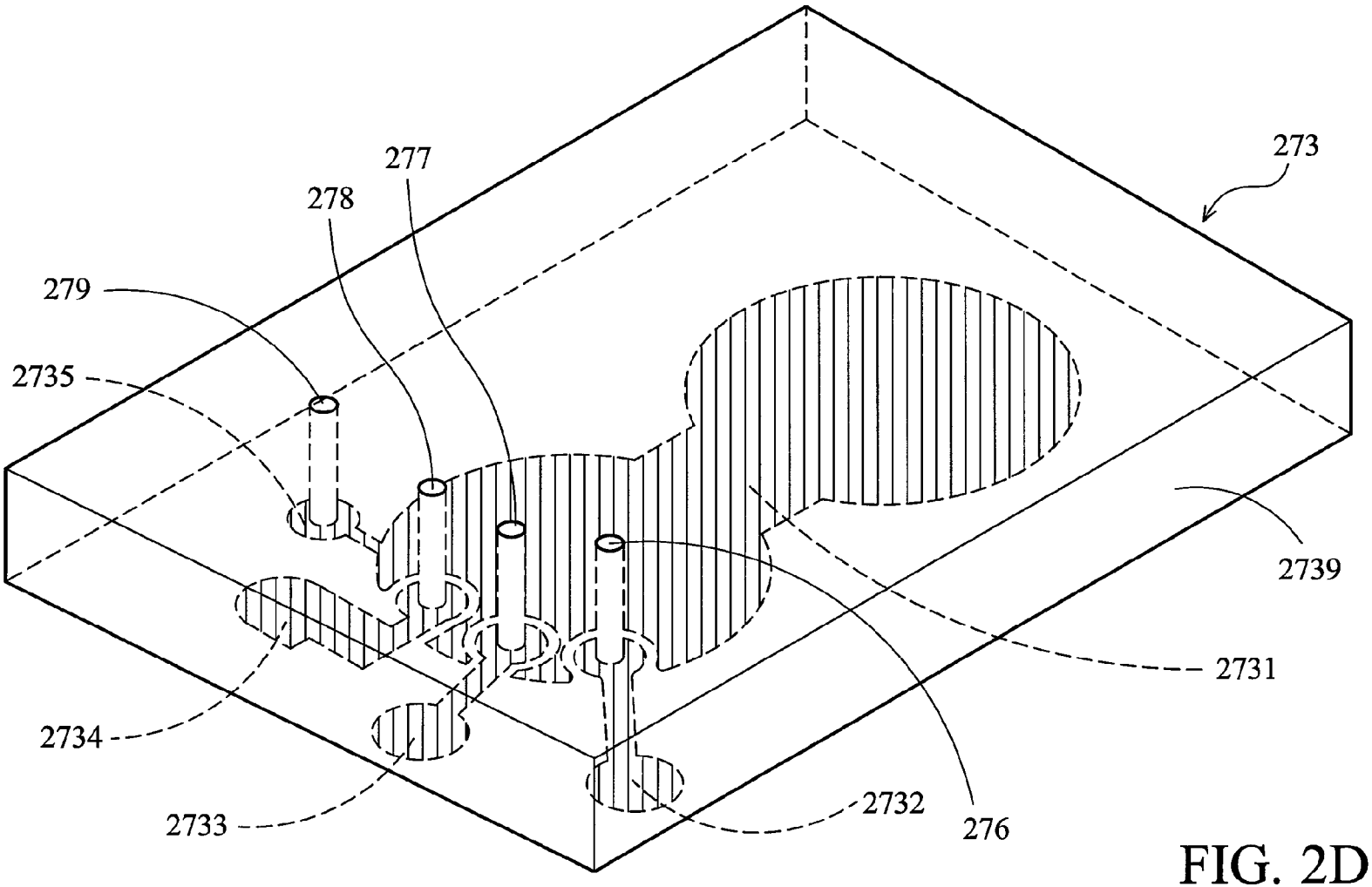
FIG. 2D depicts the third layer of the circuit board of FIG. 2A.

The first microphone 200 and the second microphone 200' have a common integrated circuit 240 to process the received sound signal, wherein the integrated circuit 240 includes a couple of analog-to-digital converters (ADCs). The circuit board 270 has three layers 271, 272, and 273. FIG. 2B depicts the first layer 271 on which the integrated circuit 240 is mounted. The integrated circuit 240 is connected to the ground via a conducting wire 235, supplied with power via a conducting wire 234, receives a clock signal via a conducting wire 233, receives a sound signal (hereafter the first electrical signal) from the first microphone 200 via a conducting wire 230, receives another sound signal (hereafter the second electrical signal) from the second microphone 200' via a conducting wire 231, and sends out a data signal via a conducting wire 232. Detailed structure is introduced in the following:

The circuit board 270 comprises a first layer 271, a third layer 273, and a second layer 272 sandwiched between the first and third layers 271 and 273. FIGS. 2B, 2C, and 2D are perspective diagrams of the first, second, and third layers, respectively. Referring to FIG. 2B, the first layer 271 has an electrically insulating substrate 2719. On the top of the substrate 2719, electrically conductive parts 2712, 2715, 2716, 2717, and 2718 are surrounded by a first shielding part 2711. Note all the electrically conductive parts 2712, 2715, 2716, 2717, and 2718 are electrically insulated from the first shielding part 2711 on the substrate 2719. Referring to FIG. 2C, the second layer 272 has an electrically insulating substrate 2729. A plurality of electrically conductive parts 2721 and 2722 are formed on the top of the substrate 2729 and electrically insulated from each other. Referring to FIG. 2D, the third layer 273 has an electrically insulating substrate 2739. A second shielding part 2731 and a plurality of electrically conductive parts 2732, 2733, and 2734 are formed on the bottom of the substrate 2739 and electrically insulated from each other.

Referring again to FIG. 2A, an electrically conductive part 274 penetrates through the first layer 271 to electrically connect the electrically conductive part 2712 of the first layer 271 and the electrically conductive part 2721 of the second layer 272. An electrically conductive part 275 penetrates through the first layer 271 to electrically connect the electrically conductive part 2715 of the first layer 271 and the electrically conductive part 2721 of the second layer 272. An electrically conductive part 276 penetrates through the first, second, and third layers 271, 272, and 273 to electrically connect the electrically conductive part 2716 of the first layer 271 and the electrically conductive part 2732 of the third layer 273. Similarly, it is understood from FIGS. 2B, 2C, and 2D that electrically conductive parts 277, 278, and 279, starting from the top of the first layer 271 (FIG. 2B) and ending at the bottom of the third layer 273 (FIG. 2D), penetrate through the first, second, and third layers 271, 272, and 273. Thus, the electrically conductive part 277 electrically connects the electrically conductive part 2717 of the first layer 271 and the electrically conductive part 2733 of the third layer 273. The electrically conductive part 278 electrically connects the electrically conductive part 2718 of the first layer 271 and the electrically conductive part 2734 of the third layer 273. The electrically conductive part 279 electrically connects the first shielding part 2711 of the first layer 271 and the grounded zone 2735 of the second shielding part 2731 of the third layer 273.

The first microphone 200 comprises a first shielding housing 210 attached to the first layer 271 of the circuit board 270, the integrated circuit 240 disposed in the first shielding housing 210, and a first electret sensor 220 also disposed in the first shielding housing 210 and electrically connected to the integrated circuit 240 via the conducting wire 230. The first shielding housing 210 has an acoustic opening 212 and contacts the first shielding part 2711 of the first layer 271. The first electret sensor 220 comprises a diaphragm 221 and a back plate 222.

The second microphone 200' comprises a second shielding housing 210' attached to the first layer 271 of the circuit board 270, and a second electret sensor 220' disposed in the second shielding housing 210'. The second electret sensor 220' is electrically connected to the integrated circuit 240 through a conducting wire 230', the electrically conductive parts 2712, 274, 2721, 275, and 2715, and the conducting wire 231. The second shielding housing 210' has an acoustic opening 212' and contacts the first shielding part 2711 of the first layer 271. The second electret sensor 220' comprises a diaphragm 221' and a back plate 222'.

Referring to FIGS. 2B, 2C, and 2D, the integrated circuit 240 is supplied with power through the conducting wire 234 and the electrically conductive parts 2718, 278, and 2734, wherein the electrically conductive part 2734 is connected to an external power (not shown).

In operation, the first electret sensor 220 receives incoming sound waves via the acoustic opening 212 and converts these sound waves into a first electrical signal. The first electrical signal is transmitted to the integrated circuit 240 via the conducting wire 230. The second electret sensor 220' also converts incoming sound waves received via the acoustic opening 212' into a second electrical signal. The second electrical signal is transmitted to the integrated circuit 240 through the conducting wire 230', the electrically conductive parts 2712, 274, 2721, 275, and 2715, and the conducting wire 231. The integrated circuit 240 receives the first and second electrical signals through the conducting wires 230 and 231, receives a clock signal from external circuitry (not shown) through the conducting wire 233, the electrically conductive parts 2717, 277, and 2733, and sends out a data signal through the conducting wire 232 and the electrically conductive parts 2716, 276, and 2732 to external circuitry (not shown).

The first shielding housing 210 and the second shielding housing 210' are grounded via the first shielding part 2711 which is electrically connected to the grounded zone 2735 of the second shielding part 2731 of the third layer 273 through the electrically conductive part 279. Thus, the first shielding housing 210, the second shielding housing 210', the first shielding part 2711, and the second shielding part 2731 constitute an electromagnetic interference (EMI) shielding means, protecting the integrated circuit 240, the conducting wires 230', 231, 230, and 232, and the electrically conductive parts 2712, 274, 2721, 275, 2715, and 2716 from EMI.

Figure 3:
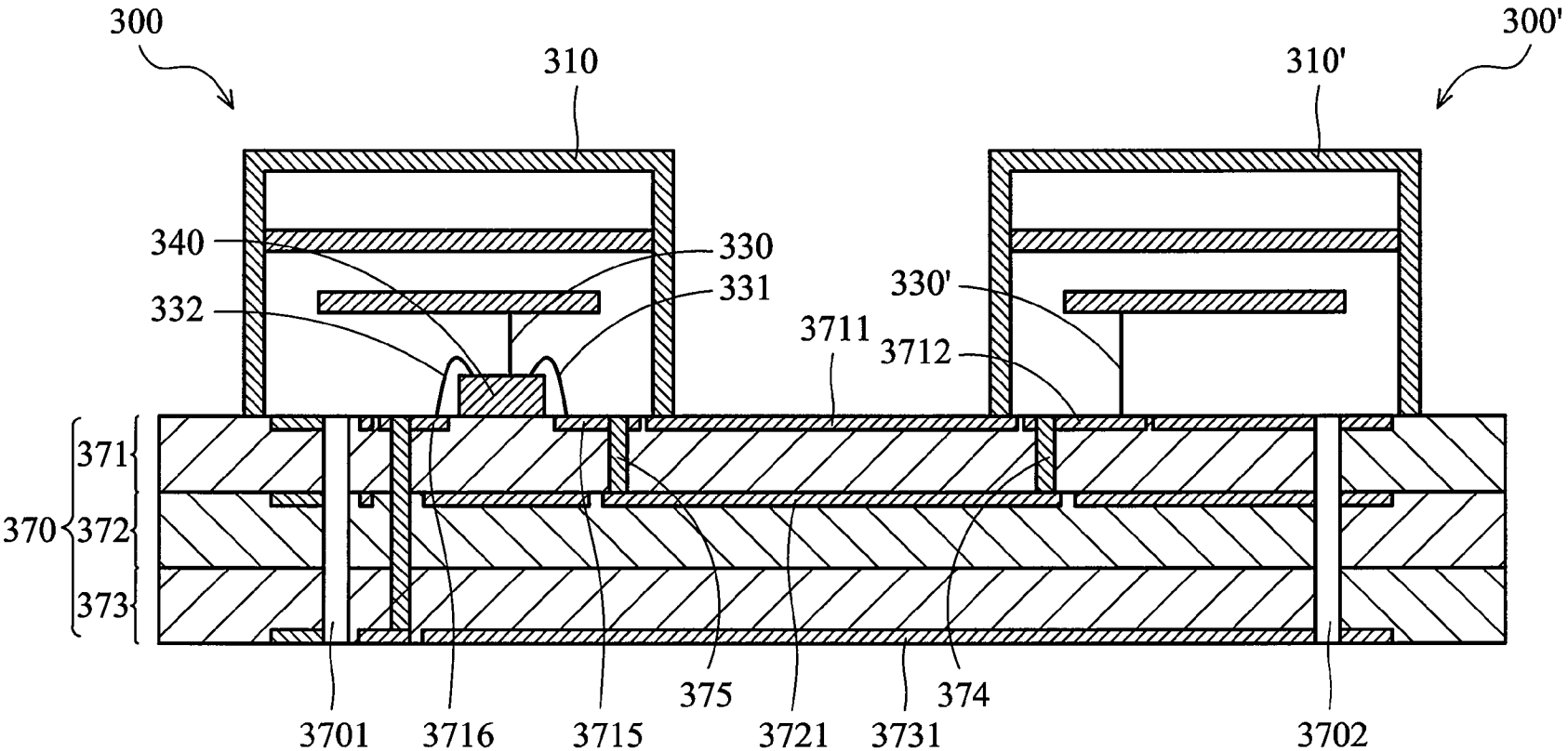
FIG. 3 shows a cross section of a microphone array in accordance with a second embodiment of the invention.

Referring to FIG. 3, a microphone array of a second embodiment of the invention comprises a first microphone 300, a second microphone 300', and a circuit board 370. Both the first and second microphones 300 and 300', mounted on the circuit board 370, are omni-directional.

The circuit board 370 comprises a first layer 371, a third layer 373, and a second layer 372 sandwiched between the first and third layers 371 and 373. Furthermore, the circuit board 370 defines acoustic openings 3701 and 3702 communicating with the interior of the first and second microphones 300 and 300', respectively.

Similar to those of the first embodiment, the first shielding housing 310, the second shielding housing 310', the first shielding part 3711, and the second shielding part 3731 constitute an electromagnetic interference (EMI) shielding means, protecting the integrated circuit 340, the conducting wires 330', 331, 330, and 332, and the electrically conductive parts 3712, 374, 3721, 375, 3715, and 3716 from EMI.

Figure 4:
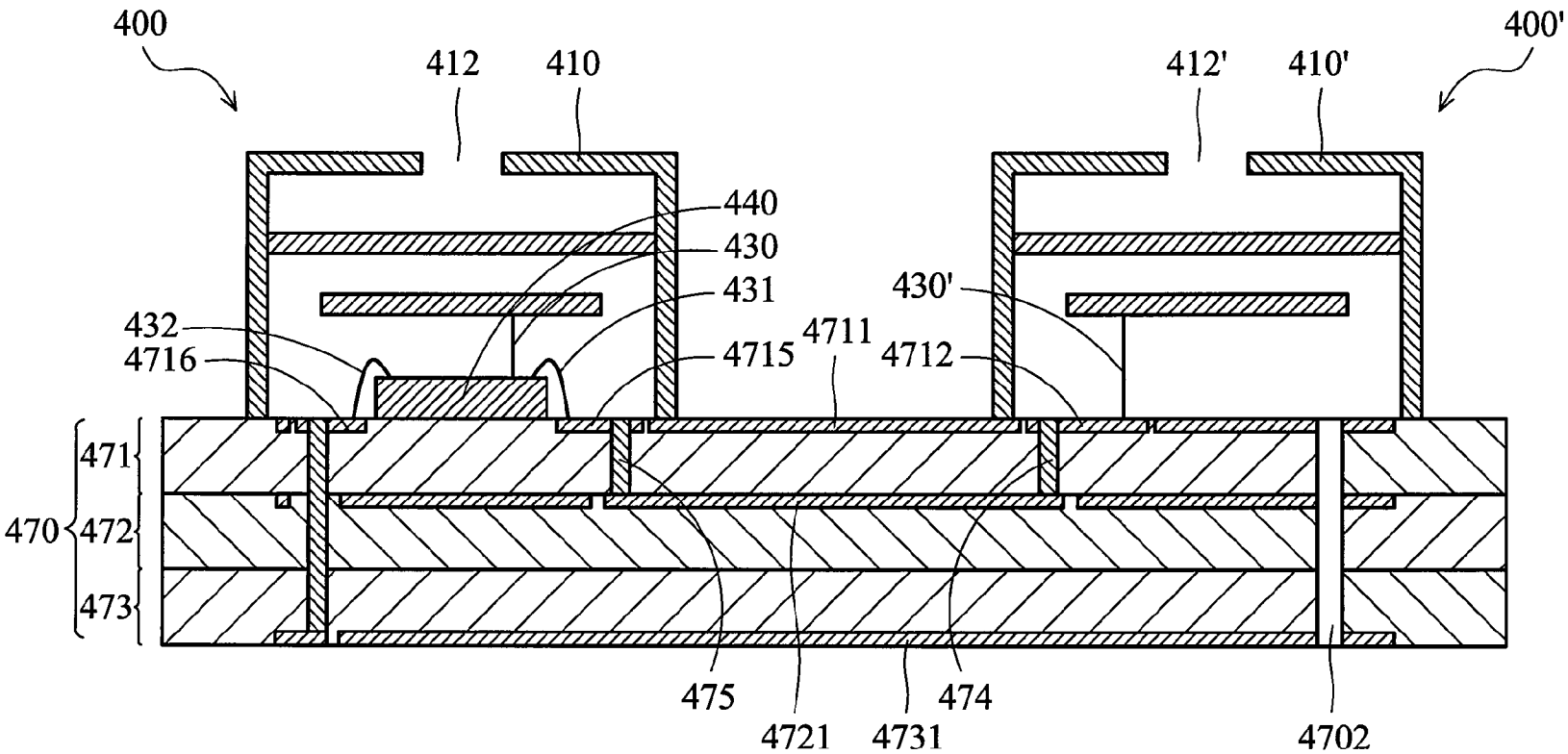
FIG. 4 shows a cross section of a microphone array in accordance with a third embodiment of the invention.

Referring to FIG. 4, a microphone array of a third embodiment of the invention comprises a first microphone 400, a second microphone 400', and a circuit board 470. The circuit board 470 comprises a first layer 471, a third layer 473, and a second layer 472 sandwiched between the first and third layers 471 and 473. The first microphone 400 is an omni-directional microphone and has an acoustic opening 412 on the first shielding housing 410. The second microphone 400' is a unidirectional microphone and has an acoustic opening 412' on the second shielding housing 410' and an acoustic opening 4702 penetrating through the circuit board 470 to communicate with the interior of thereof.

Similar to those of the first and second embodiments, the first shielding housing 410, the second shielding housing 410', the first shielding part 4711, and the second shielding part 4731 constitute an electromagnetic interference (EMI) shielding means, protecting the integrated circuit 440, the conducting wires 430', 431, 430, and 432, and the electrically conductive parts 4712, 474, 4721, 475, 4715, and 4716 from EMI.

Figure 5:
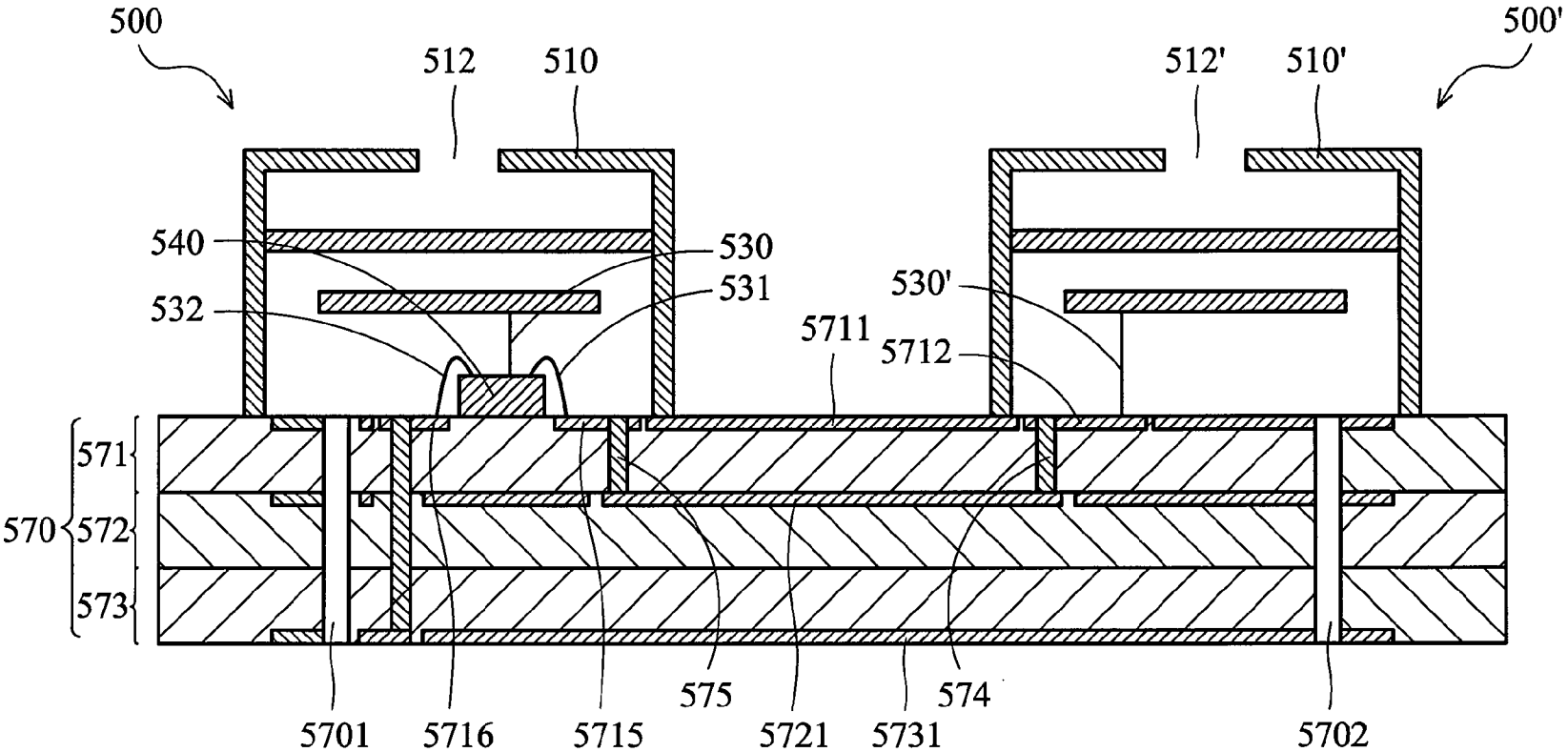
FIG. 5 shows a cross section of a microphone array in accordance with a fourth embodiment of the invention.

Referring to FIG. 5, a microphone array of a fourth embodiment of the invention comprises a first microphone 500, a second microphone 500', and a circuit board 570.

The circuit board 570 comprises a first layer 571, a third layer 573, and a second layer 572 sandwiched between the first and third layers 571 and 573.

The first microphone 500 is a uni-directional microphone and has an acoustic opening 512 on the first shielding housing 510 and an acoustic opening 5701 penetrating through the circuit board 570 to communicate with the interior of thereof. The second microphone 500' is also a uni-directional microphone and has an acoustic opening 512' on the second shielding housing 510' and an acoustic opening 5702 penetrating through the circuit board 570 to communicate with the interior of thereof.

Similar to those of the above embodiments, the first shielding housing 510, the second shielding housing 510', the first shielding part 5711, and the second shielding part 5731 constitute an electromagnetic interference (EMI) shielding means, protecting the integrated circuit 540, the conducting wires 530', 531, 530, and 532, and the electrically conductive parts 5712, 574, 5721, 575, 5715, and 5716 from EMI.

In the above embodiments, the integrated circuit is wire-bonded on the circuit board. It is understood, however, that the integrated circuit may be mounted on the circuit board via the ball grid array (BGA) technology. Furthermore, the integrated circuit may include a couple of J-channel field effect transistors (J-FETs), a couple of analog-to-digital converters (ADCs), or a digital signal processor (DSP).

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A microphone array, comprising:

a circuit board comprising a first layer, a third layer, and a second layer sandwiched between the first layer and the third layer, wherein the first layer comprises a first shielding part with a fixed electric potential, the third layer comprises a second shielding part with the fixed electric potential, and the second layer comprises an electrically conductive part running between the first and second shielding parts;

a first microphone attached to the first layer of the circuit board; and a second microphone attached to the first layer of the circuit board and electrically connected to the first microphone through the electrically conductive part of the second layer of the circuit board, wherein the first microphone comprises a first shielding housing electrically connected to the first shielding part, and the second microphone comprises a second shielding housing also electrically connected to the first shielding part.

2. The microphone array as claimed in claim 1, further comprising an electrically conductive part which penetrates through the first, second, and third layers to electrically connect the first shielding part and the second shielding part.

3. The microphone array as claimed in claim 2, wherein the second shielding part is grounded.

4. The microphone array as claimed in claim 1, further comprising an electrically conductive part which electrically connects to the first microphone and penetrates through the first, second, and third layers to transmit signals between the first microphone and external circuitry.

5. The microphone array as claimed in claim 1, wherein the first microphone comprises a first shielding housing and the first shielding housing defines an acoustic opening.

6. The microphone array as claimed in claim 1, wherein the first microphone comprises a first shielding housing, the first shielding housing has an interior, and the circuit board defines an acoustic opening communicating with the interior of the first shielding housing.

7. The microphone array as claimed in claim 1, wherein the first microphone is an omni-directional microphone or a uni-directional microphone.

* * * * *